US005893522A

United States Patent [19]

Kieffer

[11] Patent Number: 5,893,522

[45] Date of Patent: Apr. 13, 1999

[54] METHOD OF ORIENTING A SPRAY TIP IN A HOLDER

[75] Inventor: Joseph W. Kieffer, Rogers, Minn.

[73] Assignee: Wagner Spray Tech Corporation, Minneapolis, Minn.

[21] Appl. No.: 08/867,077

[22] Filed: Jun. 2, 1997

[51] Int. Cl.[6] ..... B05B 1/00

[52] U.S. Cl. ..... 239/600

[58] Field of Search ..... 239/1, 119, 525, 239/521, 600, 597

[56] References Cited

U.S. PATENT DOCUMENTS

| | | | |
|---|---|---|---|
| 2,564,431 | 8/1951 | Greenspoon | 299/107 |
| 3,116,882 | 1/1964 | York | 239/587 |
| 3,202,360 | 8/1965 | O'Brien | 239/119 |
| 3,460,757 | 8/1969 | Adams | 239/115 |
| 3,593,920 | 7/1971 | Watson | 239/119 |
| 3,645,450 | 2/1972 | Calder | 239/116 |
| 3,667,681 | 6/1972 | Blancha | 239/393 |
| 3,752,400 | 8/1973 | Calder | 239/116 |
| 3,831,862 | 8/1974 | Calder | 239/526 |
| 3,955,763 | 5/1976 | Pyle et al. | 239/119 |
| 4,074,857 | 2/1978 | Calder | 239/119 |
| 4,108,379 | 8/1978 | Talley | 239/119 |
| 4,116,386 | 9/1978 | Calder | 239/119 |
| 4,157,163 | 6/1979 | Pinto et al. | 239/119 |
| 4,165,836 | 8/1979 | Eull | 239/119 |
| 4,437,610 | 3/1984 | Huber et al. | 239/119 |
| 4,465,236 | 8/1984 | Calder | 239/391 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,513,913 | 4/1985 | Smith | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,629,121 | 12/1986 | Hengesbach | 239/119 |
| 4,635,850 | 1/1987 | Leisi | 239/119 |
| 4,682,731 | 7/1987 | Bolton | 239/119 |
| 4,715,537 | 12/1987 | Calder | 239/119 |
| 4,736,892 | 4/1988 | Calder | 239/592 |
| 4,757,947 | 7/1988 | Calder | 239/119 |
| 4,819,872 | 4/1989 | Rosenberg | 239/119 |
| 4,830,281 | 5/1989 | Calder | 239/119 |
| 4,971,249 | 11/1990 | Tam et al. | 239/119 |
| 5,094,402 | 3/1992 | Perret, Jr. et al. | 239/526 |
| 5,155,895 | 10/1992 | Jakiela et al. | 239/453 |
| 5,255,848 | 10/1993 | Rhodehouse | 239/119 |
| 5,280,853 | 1/1994 | Perret, Jr. | 239/119 |
| 5,294,053 | 3/1994 | Perret, Jr. | 239/119 |
| 5,340,029 | 8/1994 | Adams | 239/119 |
| 5,379,938 | 1/1995 | Perret, Jr. | 239/119 |
| 5,379,939 | 1/1995 | Perret, Jr. | 239/119 |
| 5,454,515 | 10/1995 | Perret | 239/119 |
| 5,505,381 | 4/1996 | Torntore | 239/119 |

*Primary Examiner*—Kevin Weldon
*Attorney, Agent, or Firm*—Faegre & Benson LLP

[57] ABSTRACT

A method of orienting a misaligned spray tip in a reversible turret of a paint spray gun by tapping the turret to rotate the tip until a key and keyway of the tip and turret are aligned. In one embodiment of the method, the turret is held in the left hand and tapped with the right hand to cause counter-clockwise rotation of the tip. In another embodiment, the turret is held in the right hand and the turret is tapped with the left hand to cause clockwise rotation of the tip in the turret. Once the tip is oriented in the turret, an elastomer washer and hollow retaining screw are installed in the turret behind the tip to seal and retain the tip in the turret, and the turret is installed in the paint spray gun.

11 Claims, 2 Drawing Sheets

METHOD OF ORIENTING A SPRAY TIP IN A HOLDER

BACKGROUND OF THE INVENTION

This invention relates to the field of portable paint spraying equipment of the type having a high pressure, airless spray head assembly having a replaceable tip in a tip holder (which holder may be a reversible turret). More particularly, the invention relates to orienting the spray tip in the holder as is necessary in the process of installing a replacement tip in the holder.

DETAILED DESCRIPTION OF THE INVENTION

Figure 1:
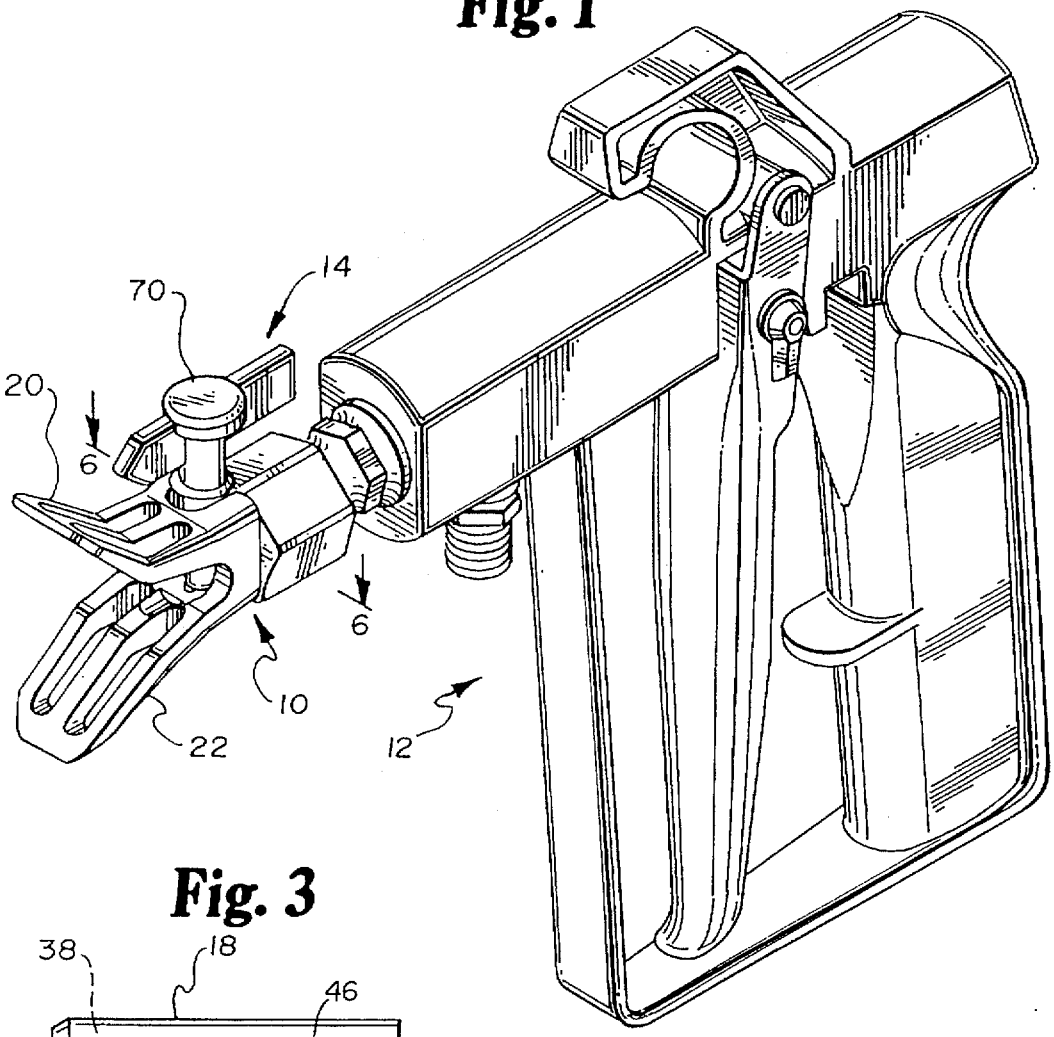
FIG. 1 is a perspective view of a spray gun carrying a spray head assembly useful in the practice of the present invention.

Referring to the Figures and most particularly to FIG. 1, a spray head assembly 10 useful in the practice of the present invention may be seen. Spray head assembly 10 is shown attached to an airless spray gun 12 suitable for spraying paints and other similar coating materials under relatively high pressure. In such spraying applications, it has been found useful to provide a reversible mounting for the spray orifice to clear blockages. In the past, such mountings were provided by a turret assembly which had a tip with a desired orifice permanently installed in the turret. Once the orifice was worn to an unacceptable extent, the entire turret was required to be replaced.

Figure 2:
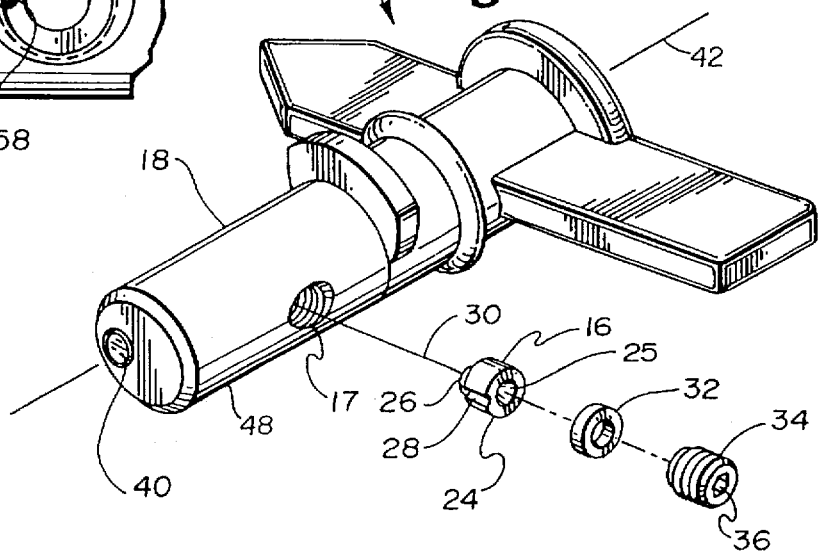
FIG. 2 is an exploded view of a turret and user-replaceable parts useful in the practice of the present invention.

Referring now also to FIG. 2, in the practice of the present invention the tip is replaceable in the turret 4 when the orifice is worn. This is achieved by providing a turret assembly 14 which has a spray tip 16 which may be replaced by an operator. Spray tip 16 is received in a bore 17 extending along a transverse axis 30 oriented perpendicular to a primary cylindrical axis 42 of a barrel 18 of the turret assembly 14. Spray tip 16 is preferably formed of carbide and has a "cat's eye" orifice therein requiring proper orientation to the barrel 18 to align the orifice with the spray guard wings 20 and 22. Tip 16 preferably has a generally cylindrical base 24 and a hemispherical or domed top portion 26. Base 24 also has a groove or indentation 28 aligned with the cylindrical axis 30 of the base portion 24. Indentation 28 functions as a keyway when tip 16 is inserted into barrel 18. A resilient washer-like seal 32 (preferably formed of Delrin plastic, available from DuPont) is located behind the base portion 24 of tip 16. A hollow set screw 34 is threaded into bore 17 to retain tip 16 and seal 32 in barrel 18. It is to be understood that the through bore of set screw 34 preferably has a hexagonal cross section 36 extending from the rear face thereof at least partially through the set screw 34 to receive a conventional Allen wrench (not shown) for installation and removal of the set screw 34 from barrel 18. Once a new tip is installed, a corresponding plug 70 may be installed in the end of turret assembly 14 to identify the characteristics (typically the orifice size) of the tip 16 then installed in assembly 14.

Figure 3:
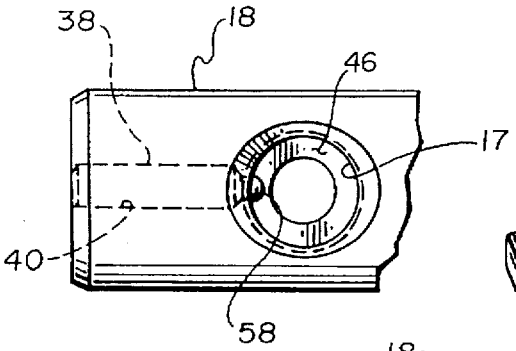
FIG. 3 is a detail view of a portion of the turret of FIG. 2.

Referring now also to FIG. 3, barrel 18 preferably has a locator pin 38 received therein in a bore 40 aligned parallel to the cylindrical axis 42. Pin 38 preferably has an interference fit with bore 40 and is pressed into bore 40, resulting in a permanent installation. Once installed, pin 38 has a dome or key 58 projecting into bore 17.

While it is possible, it has been found inconvenient to manually pre-orient or align the groove or keyway 28 of tip 16 with key 58 before inserting the tip into the bore 17, because the tip has a tendency to become misaligned as it moves into the bore along axis 30. Once the tip 16 is received in the barrel or cylinder 18, it is to be understood that the tip 16 is fully recessed below the cylindrical surface 48 of barrel 18 even when the keyway 28 is misaligned with key 58, making it difficult to then rotate tip 16 to bring keyway 28 into alignment with key 58. One method that can be used to align the key and keyway is to repeatedly attempt to pre-align and drop tip 16 into bore 17, removing the tip when alignment is not immediately achieved as the tip enters the bore. Such a process has been found to be tedious and frustrating to an operator interested in efficient installation of a replacement tip. Another method is to place the tip 16 on the end of an instrument, such as a pencil or ball point pen (not shown), with the tip of the instrument received in a bore 25 in the base 24 of the tip 16, and then guide the tip into the bore 17 in the turret while attempting to maintain alignment of the keyway 28 with the key 58. Such a method has also been found to be burdensome in the degree of manual dexterity and attention required by the operator. Of course still other techniques could be used, such as having a specially made instrument (also not shown) which is capable of releasably grasping the tip (for example, by contact with the interior of bore 25), but such a special instrument adds cost and may not be conveniently available when needed.

The present invention provides a relatively rapid and convenient method of orienting the tip 16 with the holder or turret barrel 18 requiring only that the tip be aligned with respect to the axis 30.

Figure 4:
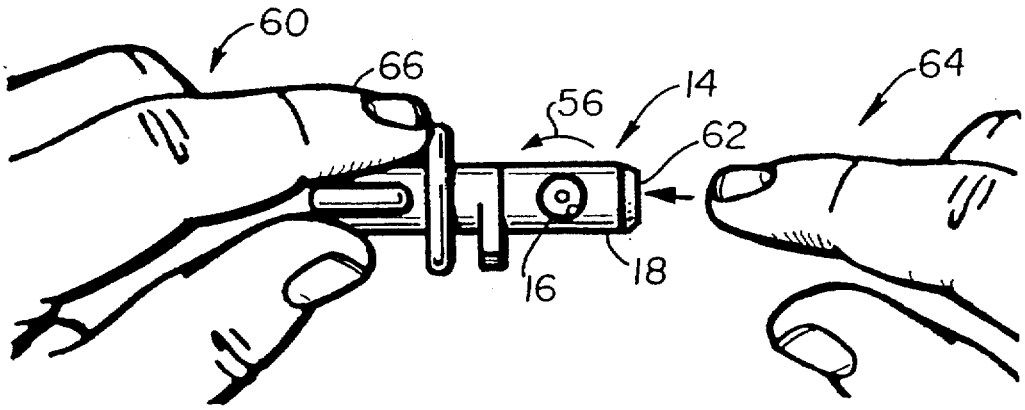
FIG. 4 is a top view of the turret of FIG. 2 held in a user's left hand showing a method of orienting a tip counterclockwise with the user's right hand.
Figure 5:
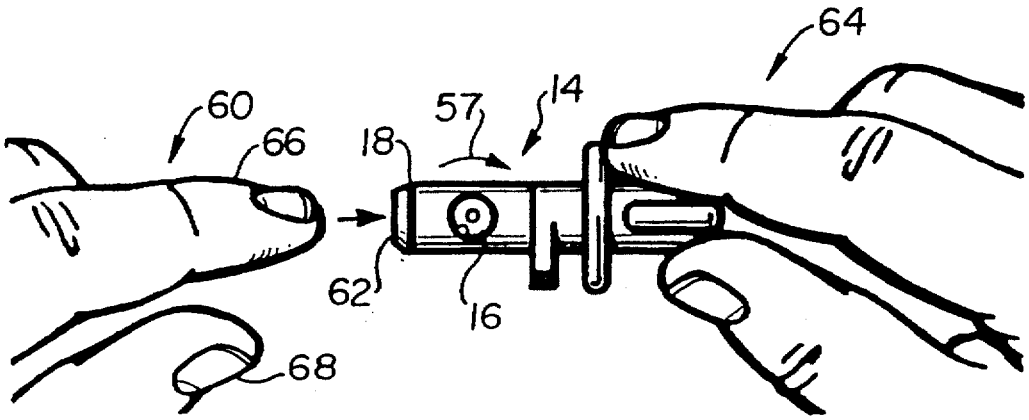
FIG. 5 is a top view of the turret of FIG. 2 held in a user's right hand showing a method of orienting the tip clockwise with the user's left hand.

The present invention avoids the inconvenience of pre-orienting the keyway and key. In the practice of the method of the present invention, tip 16 is placed into bore 17 without regard to the orientation of the keyway 28 to the key 58. If the keyway 28 is aligned with the projection 58 the tip 16 will move axially into contact with shoulder 46 immediately, without the need of practicing the present invention. If, however, the keyway 28 is misaligned with key 58, the turret assembly 14 is grasped in either the right or left hand as shown in FIGS. 4 or 5. One finger, such as the index finger, of the other hand is then used to tap the end of the turret barrel 18, which has been found to cause the tip 16 to rotate in bore 17 of barrel 18. Tapping is repeated until the keyway 28 and the projection 58 are aligned and the tip moves axially (preferably via gravity) into full engagement with the shoulder 46 in bore 17 of barrel 18.

Seal 32 is then installed behind tip 16 and hollow set screw 34 is threaded into the threaded portion 42 of bore 17, preferably using the Allen wrench to compress seal 32 against tip 16 to prevent leakage around the outer surface of tip element 16. To remove tip 16, the process is reversed, first unthreading set screw 34 using Allen wrench 160, then removing seal 32 and tip 16.

It has further been found desirable to note whether clockwise or counterclockwise rotation of the tip in the holder is desirable to minimize the rotation necessary to align the tip with the holder (such as turret barrel). If the tip 16 is desired to be rotated counterclockwise (as indicated by arrow 56), the turret assembly 14 is held in the left hand 60 and the end 62 of the turret barrel 18 is tapped with the right hand 64, as shown in FIG. 4. If the tip 16 is desired to be rotated clockwise (as indicated by arrow 57), the turret assembly 14 is held in the right hand and the end 62 of the barrel 18 is tapped with a finger 66 of the left hand 60, as shown in FIG. 5. Although the index or forefinger is shown in a position to tap the end 62 of the barrel 18, any of the fingers or digits (including the appropriate thumb, e.g., 68) may be utilized. Furthermore, the tapping hand may strike the barrel 18 at locations other than directly on the end thereof while still remaining within the present invention, provided that the tip is caused to rotate in response to the tapping.

The invention is not to be taken as limited to all of the details thereof as modifications and variations thereof may be made without departing from the spirit or scope of the invention.

What is claimed is:

1. A method of orienting a misaligned spray tip in a holder comprising the steps of:

a) grasping the tip holder in one hand when the tip and holder are misaligned; and b) tapping the holder with the other hand such that the tip is caused to rotate in the holder until the tip is aligned with the holder.

2. The method of claim 1 wherein the holder is a reversible turret.

3. The method of claim 1 wherein the one hand is a left hand of a user and the other hand is a right hand of the user.

4. The method of claim 1 wherein the one hand is a right hand of a user and the other hand is a left hand of the user.

5. The method of claim 1 wherein the holder is a reversible turret having a transverse bore for holding the tip proximate one end thereof and having a handle distal of the one end and step a) further comprises grasping the handle of the holder.

6. The method of claim 5 wherein step a) further comprises grasping the handle of the holder with a thumb and an index finger of the one hand.

7. The method of claim 5 wherein step b) further comprises tapping the end of the turret proximate the transverse bore.

8. The method of claim 1 wherein step b) further comprises tapping the end of the turret with a finger of the other hand.

9. The method of claim 8 wherein the finger is an index finger.

10. A method of installing a paint spray tip in a reversible turret of a paint spray gun comprising the steps of:

a) placing the paint spray tip in a transverse bore of the turret;

b) grasping the turret in one hand when the tip and turret are misaligned;

c) tapping the turret with a finger of the other hand such that the tip is caused to rotate in the turret until the tip is aligned with the turret;

d) placing a seal behind the tip in the transverse bore; and e) threading a retaining screw into the transverse bore to retain the tip and seal to the turret.

11. The method of claim 10 further comprising the additional step of:

f) installing the reversible turret in the paint spray gun.

* * * * *